United States Patent [19]

Jarrett

[11] Patent Number: 5,056,686

[45] Date of Patent: Oct. 15, 1991

[54] BEVERAGE DISPENSING SYSTEM

[75] Inventor: Charles C. Jarrett, Bellevue, Wash.

[73] Assignee: Nutri-Fruit, Inc., Bellevue, Wash.

[21] Appl. No.: 530,116

[22] Filed: May 29, 1990

Related U.S. Application Data

[63] Continuation-in-part of Ser. No. 372,837, Jun. 27, 1989, abandoned.

[51] Int. Cl.[5] ..... B67D 5/56

[52] U.S. Cl. ..... 222/129.2; 222/144.5; 222/325

[58] Field of Search ..... 222/129.1–129.4, 222/132, 135, 144.5, 148, 189, 249, 255, 608, 626, 325

[56] References Cited

U.S. PATENT DOCUMENTS

| | | | |
|---|---|---|---|
| 3,703,187 | 11/1972 | Booth | 137/114 |
| 3,830,405 | 8/1974 | Jaeger | 222/129.3 |
| 3,863,810 | 2/1975 | Hanson | 222/129.1 |
| 3,940,019 | 2/1976 | Kross et al. | 222/30 |
| 4,154,368 | 5/1979 | Gusmer et al. | 222/135 |
| 4,162,028 | 7/1979 | Reichenberger | 222/129.4 |
| 4,194,650 | 3/1980 | Nottke et al. | 222/57 |
| 4,582,226 | 4/1986 | Doak | 222/148 |
| 4,606,476 | 8/1986 | Pocock et al. | 222/148 |
| 4,703,870 | 11/1987 | Sedan | 222/66 |
| 4,765,513 | 8/1988 | McMillin et al. | 222/129.1 |
| 4,795,061 | 1/1989 | Peckjian | 222/67 |
| 4,887,740 | 12/1989 | Smith | 222/129.1 |

FOREIGN PATENT DOCUMENTS

| | | |
|---|---|---|
| 0370150A1 | 3/1989 | European Pat. Off. . |
| 2146620A | 4/1985 | United Kingdom . |

OTHER PUBLICATIONS

SHURflow Single Pump Flow Routing Diagram, Mar. 1990.

*Primary Examiner*—Michael S. Huppert
*Assistant Examiner*—Gregory L. Huson
*Attorney, Agent, or Firm*—Christensen, O'Connor, Johnson & Kindness

[57] ABSTRACT

A beverage dispensing system for providing a number of different flavored drinks mixed from concentrate and fluid. The system has a number of containers for storing different flavors of concentrate and a piping system including a coupling adapted to receive pressurized fluid, such as water, from an external source. Each container is in fluid communication with a specific fluid-driven proportion pump that is also in fluid communication with the piping system. Separate concentrate and fluid supply lines extend from each pump to a dispensing head. Valves in the dispensing head control the discharge of fluid therefrom so that when a selected beverage is desired, the appropriate concentrate and fluid from the associated fluid supply line are discharged simultaneously to ensure that the end beverage contains the appropriate mixture of concentrate and fluid so as to be of acceptable quality.

23 Claims, 4 Drawing Sheets

BEVERAGE DISPENSING SYSTEM

This application is a continuation-in-part of co-pending U.S. Pat. application Ser. No. 07/372,837, filed June 27, 1989 and now abandoned.

FIELD OF THE INVENTION

This invention pertains to a beverage dispensing system, and, more particularly, to a portable beverage dispensing system for selectively dispensing any one of number of beverages that are mixtures of concentrate and water.

BACKGROUND OF THE INVENTION

Beverage dispensers are used at many locations to provide consumers with beverages, such as fruit juices, that are a mixture of previously stored concentrate and fluid such as water. Many beverage dispensers have a space for storing the concentrate and a plumbing system which includes an inlet coupling through which fluid from an external source is supplied. A proportion pump is used to force the concentrate and water separately to a dispensing nozzle where it is mixed immediately prior to being discharged into a cup or other container. Ofter, a double-acting piston pump is used to force the concentrate and water to the discharge nozzle. The pump is set to deliver the mixture at a set ratio, for example between 4:1 and 5:1 parts water to concentrate.

An important consideration when providing beverages is preventing the growth of fungus and bacteria, which can contaminate the end product and be a source of gastric distress. Most beverage concentrates are provided with sodium benzoate and other preservatives in order to inhibit the growth of fungus and bacteria. However, once the beverage concentrate and water is mixed, the preservatives are diluted to the point where they are no longer effective for inhibiting the growth of fungus and bacteria. Fungus and bacteria frequently develop within the beverage dispenser plumbing downstream from the point where product concentrate and water are mixed. One means of minimizing the growth of fungus and bacteria in beverage dispensers is to have separate product concentrate and water lines that are not joined until they reach the dispenser nozzle.

The requirement that concentrate and water be kept separate prior to discharge has made it difficult to provide beverage dispensers capable of delivering two or more different types of beverages. One disadvantage of the prior systems is that they are unable to consistently deliver the exact amount of water needed to properly dilute the concentrate. Consequently, these systems produce beverages of uneven, and sometimes unacceptable, quality. Moreover, these systems typically employ either electrically or gas (CO2) driven pumps. Providing beverage dispensers with these pumps adds to both the cost and complexity of their operation.

SUMMARY OF THE INVENTION

This invention is directed to a beverage dispensing system for providing different beverages that are formed from mixtures of concentrate and fluid. The invention includes a set of containers in which different flavored beverage concentrate are stored and an internal piping system including a coupling adapted to receive pressurized fluid, such as water, from an external source. Concentrate is pumped from each container by a fluid-driven proportion pump associated with the container. A pair of concentrate and fluid outlet, or supply, lines are connected to outlet ports on the individual pumps so that for each concentrate supply line there is an associated fluid supply line. The concentrate and fluid supply lines for each flavor beverage terminate at a dispensing head such as the head of a bar gun. The flow of concentrate and fluid through the dispensing head is controlled by a set of push-button actuated valves. Each valve is arranged to control fluid flow through a fluid supply line associated with a specific concentrate supply line. When delivery of a specific beverage is desired, the associated valve is actuated so that the fluid supply line is opened. The fluid flows out of the supply line. The flow of fluid through the pump powers the "concentrate side" of the pump so that the desired concentrate is pumped through and discharged from its supply line. The concentrate and fluid mix at the dispensing head to produce the desired beverage.

The beverage dispensing system of this invention keeps beverage concentrate and fluid separated until the point where they are simultaneously mixed together and discharged. Consequently, except at the readily cleanable discharge point, there is no portion of the system where fungal and bacterial growth are prone to occur. Thus, this system can thus be operated without substantial risk that unchecked fungal and bacterial growth will develop and contaminate the beverages being dispensed.

A further advantage of the invention of this system is that it is capable of selectively supplying any one of a number of beverages through the separate pairs of beverage concentrate and fluid supply lines that terminate at the dispensing point. Since each beverage concentrate line has an associated fluid supply line, the correctly proportioned concentrate-fluid mixture will be consistently discharged at the discharge point. Thus, the system will consistently dispense high quality beverages.

Still another advantage of this system is that the pumps used to supply the fluid and concentrate are driven by the pressure of the fluid supplied to the system. This invention thus eliminates the need to provide pumps driven by electricity or other external power sources. Thus, this beverage dispensing system is both relatively economical to operate and relatively simply to use.

BRIEF DESCRIPTION OF THE DRAWINGS

The foregoing and other features and advantages of the present invention will be more readily appreciated as the same become better understood from the following detailed description when taken in conjunction with the drawings, wherein.

DETAILED DESCRIPTION OF THE INVENTION

Figure 1:
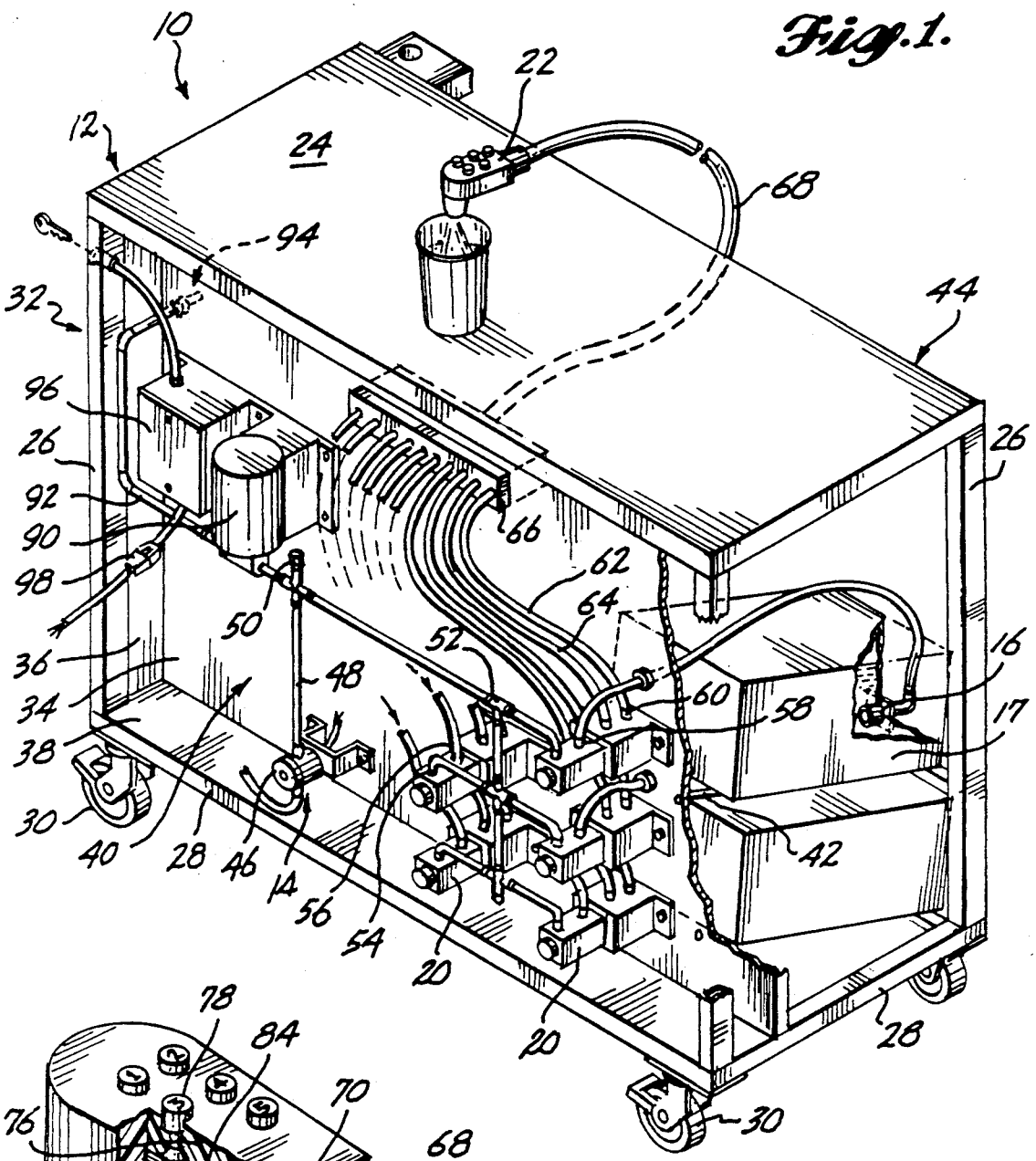
FIG. 1 is an isometric view of the fluid-dispensing system formed in accordance with the present invention.

Referring initially to FIG. 1, a beverage dispensing system 10 is shown to include a frame 12 with space for storing five cartons 18, (two shown) that contain beverage concentrate such as a fruit juice concentrate. There is a fluid coupling 14 attached to the frame 12 for receiving pressurized fluid, such as water, from an external source. The system 10 has five fluid driven pumps 20, one for each carton 18, for supplying the concentrate and fluid to a dispensing head 22. Concentrate and fluid from the individual pumps 20 are supplied to the dispensing head through separate pairs of concentrate and fluid supply lines, 62 and 64, respectively.

The frame 12 includes a top 24, legs 26 extending down from the top, bottom side rails 28 connecting the lower portions of the legs 26, and wheels 30 mounted on each of the legs 26 to facilitate moving of the frame 12. Rear portion 32 of the frame 12 has a vertical wall 34 that extends downward from top 24 to bottom rails 28 and is partially enclosed by side walls 36 and a bottom wall 38 to form an enclosure 40. Mounted within the enclosure 40 are pumps 20 and other elements of the system 10 of this invention as will be described below. A rack 42 attached to the bottom rail 28 at the front 44 of the frame 12 and the wall 34 supports the individual beverage concentrate cartons 18. The rack 42 has a number of inclined supports (not illustrated) on which the cartons 18 rest to ensure that their contents flow to openings 45 located at the lowest points in the cartons.

Fluid coupling 14 is attached to the vertical wall 34 to permit coupling of the system 10 to a source of pressurized fluid. Typically, the source of fluid is taken from a tap off existing plumbing at the facility where the system 10 is being used. Immediately downstream from the fluid coupling 14 is a fluid pressure regulator 46 that maintains the fluid pressure at a predetermined desired level suitable for operation of the pumps 20. Fluid is supplied from the regulator 46 to the pumps 20 through fluid lines 48, a connector 50, and a series of connectors 52 adjacent the the pumps 20.

Fluid communication between each carton 18 and associated pump 20 is through an automatic valve 16 attached to the carton opening 45 and an inlet line 17 extending between the valve and the pump. The automatic valves 16, which are known in the art, sense the presence of a vacuum in the carton 18 as it is depleted. When the vacuum reaches a predetermined level, the valve 16 disables the pump 20 to notify the operator that the carton needs to be replaced.

The pumps 20 are fluid driven proportion pumps available from the Shurflow Pump Company, of Santa Ana, Calif. Each pump 20 includes a fluid inlet port 54 to which a branch fluid line 48 is connected, and a concentrate inlet port 58 to which a concentrate inlet line 17 is connected. Each pump 20 further includes a fluid outlet port 56 to which a fluid supply line 64 is connected and a concentrate outlet port 60 to which a concentrate supply line 62 is connected.

Each pump 20 operates as fluid-driven motor to pump concentrate from the carton 18 in which it is stored, through the concentrate supply line 62 and to the dispensing head 22. Each pump is driven by the flow of fluid from the fluid inlet port 54 to the fluid outlet port 56. Fluid flow through the pump 20 causes the pump to draw concentrate from the carton 18 through the juice inlet port 58 at a predetermined ratio to the flow rate of the fluid. In the described embodiment of the invention, this ratio is approximately four parts fluid to one part concentrate. However, other ratios of fluid may be pumped as required by substituting other pumps. The concentrate and fluid discharged from each pump is forced through the concentrate and fluid supply lines 62 and 64 respectively to the dispensing head 22. The individual supply lines 62 and 64 are bound together at a manifold 66 attached to the top of the frame wall 34 and are bundled together in a common sheath 68 to which the dispensing head 22 is attached.

Figure 2:
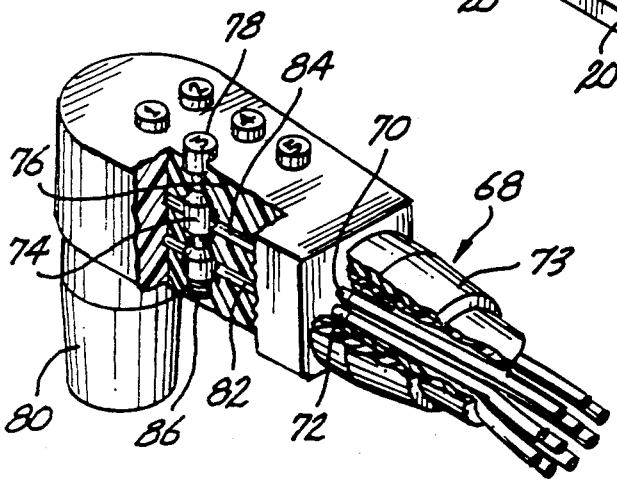
FIG. 2 is an enlarged isometric view of the dispensing nozzle of this invention.

The dispensing head 22, as shown in FIG. 2, has a body 76 in which five fluid passageways 82 and five concentrate passageways 84 are formed. Each fluid passageway has an inlet port 72 to which a fluid supply line 64 is connected. Each concentrate passageway 84 has an inlet port 70 to which a concentrate supply line 62 is connected. An outer shell 73 is attached to the body 76 around the portsupply line interfaces to protect the supply lines 62 and 64 from damage due to chafing, etc. The passageways 82 and 84 terminate at outlet openings (not illustrated) in a nozzle 80 at the end of the dispensing head 22. Passageways 82 and 84 are positioned in the dispensing head body so that at at least one point each concentrate passageway 84 overlaps the paired fluid passageway 82.

Fluid flow through the dispensing head 22 is controlled by five button-actuated, twin-spool valves 74. The valves 74 for the individual beverages are located at a point where the concentrate passageway 84 for the beverage overlaps the paired fluid passageway 82. Each valve 74 has a spindle 86 that carries two axially aligned spools 87 and 88 that respectively control fluid flow through the concentrate passageway 84 and the paired fluid passageway 82. The valves 74 are normally biased to block fluid flow through the passageways 82 and 84. Depressing a button 78 associated with a valve 76 opens the fluid and concentrate passageways 82 and 84. The fluid, which is under pressure at its source, starts to flow through the fluid line 48, the pump 20, the fluid outlet line 64, and is discharged from the dispensing head 22. The fluid flow powers the pump 20 so that the concentrate is pumped from its carton 18 through the concentrate supply line 62 and is discharged from the dispensing head 22. Upon discharge, the fluid and concentrate mix so as to form the desired beverage. Specifically, the system 10 is capable of diluting orange juice concentrate, which has a sugar content of approximately 52° Brix, so that when dispensed in beverage form it has a sugar content of between 12.2° and 12.4° Brix, which is the range of sweetness most consumers find pleasing. In the described embodiment of the invention, combined flow of concentrate and fluid out of the dispensing head is between 1.75 and 2.00 ounces per second.

The described dispensing head 22 can be assembled by making improvements to a bar gun available from Bar Mates Fluidic Systems, Inc., Los Angeles, Calif. and described in U.S. Pat. No. 3,863,810, incorporated herein by reference. Specifically the bar gun of that disclosure is modified so that each concentrate passageway 84 is provided with an associated fluid passageway 82. In embodiments where only three pumps and valves are used, a total flow rate in the range of 1.75 ounces per second to 2.50 ounces per second can be achieved, with a preferable flow rate of 2.25 ounces per second.

Referring again to FIG. 1, also shown in an auxiliary electric pump 90 attached to the frame 12 and in fluid communication with connector 50. A fluid line 92 passes from the auxiliary pump 90 to a fitting 94 that projects through the vertical wall 34 and extends towards the front 44 of the frame 12. The auxiliary pump 90 is used to draw a sanitizing solution from an outside container through the fitting 94 and fluid line 92. The pump 90 then forces the sanitizing solution through the four-way connector 50 and into the pumps 20 and through the dispensing head 22 to sterilize all fluid lines and ports. In addition, the automatic valves 16 are placed in the sanitizing solution and the pumps 20 draw the solution through the product lines and force the solution through the dispensing head 22 to sterilize all product lines and ports. An electronic control box 96 is also attached to the vertical wall 34 adjacent the pump 90 to provide on-off control to the pump 90. The electronic control box 96 has a plug 98 for supplying power to the pump 90 from a conventional electric outlet.

Figure 3:
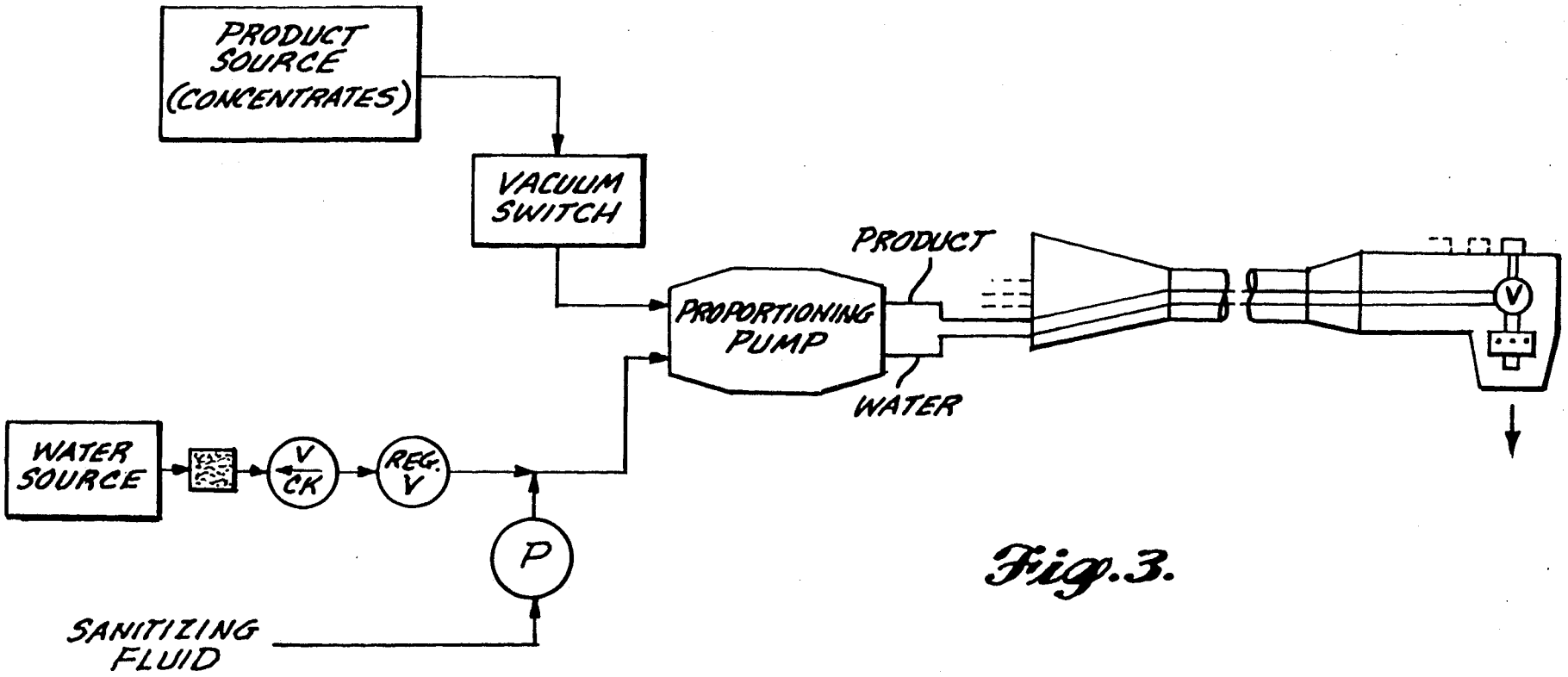
FIG. 3 is a functional block diagram of the fluid dispensing system of FIG. 1.

Referring to FIG. 3, it can be seen that a check valve 100 is placed between the regulator 46 and the fluid source 102 to prevent the introduction of sanitizing fluid into existing fluid lines, i.e., municipal water lines. In addition, a carbon filter 104 may be placed between the fluid source 102 and the check valve 100 to filter the fluid prior to its introduction to the pumps 20. The regulator 46 is mounted on the cart frame 12 downstream from the quick-disconnect fluid coupling 14 (shown in FIG. 1). All of the reference numbers are identical to those used above in FIGS. 1 and 2.

The beverage dispensing system 10 of this invention is capable of providing any one of a number of different beverages made from a concentrate and fluid mixture. The separate concentrate and fluid supply lines, 62 and 64 respectively, keep the concentrate and fluid from mixing until they are discharged for consumption as a drink. Thus, preservatives in the concentrate are not diluted to the point where they are ineffective for inhibiting the growth of fungus and bacteria. Consequently, concentrate stored by this beverage dispensing system is contained within a sterile environment which preserves both its wholesomeness and flavor.

The individual pumps 20 and fluid supply lines 64 for the different beverages supplied by the dispensing system 10 deliver the correct amount of fluid for each drink mixed. This ensures that dispensed beverages will consistently have an acceptable quality taste to the consumer.

The pumps 20 which supply concentrate for this beverage dispensing system 10 are powered by the internal pressure of the fluid supplied to the system. Since the pumps 20 are self powered, there is no need to provide an external power such as electricity or a charging gas in order to dispense the desired beverages. The beverage dispensing system 10 is thus both economical to operate and easy to use and maintain.

Still another advantage of this beverage dispensing system 10 is that it is capable of discharging two or more different concentrates in the correct proportion to the diluting fluid in order to produce a "blended flavor" drink. Such a drink can be dispensed by simply simultaneously pressing the buttons 78 associated with the valves the control the flow of the concentrate needed to make the blended drink. The multiple fluid and concentrate passageways, 82 and 84 respectively, are then opened so that for each flavor beverage that forms part of the blended drink, the correct proportion of concentrate to diluting fluid is dispensed. The final drink will thus have a concentrate to diluting fluid mixture that is of acceptable taste.

Figure 4C:
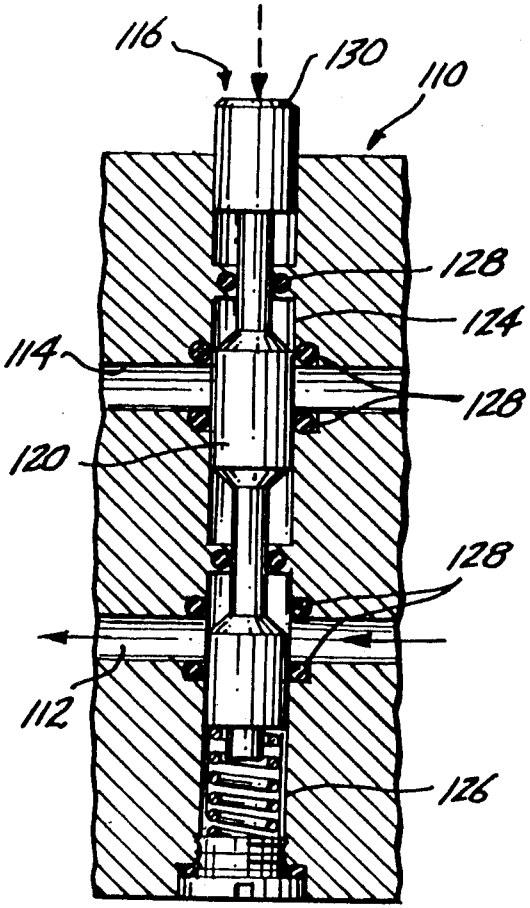
FIGS. 4*a*–4*c* are sectional views of the valve structure of an alternative dispensing nozzle of this invention.
Figure 4B:
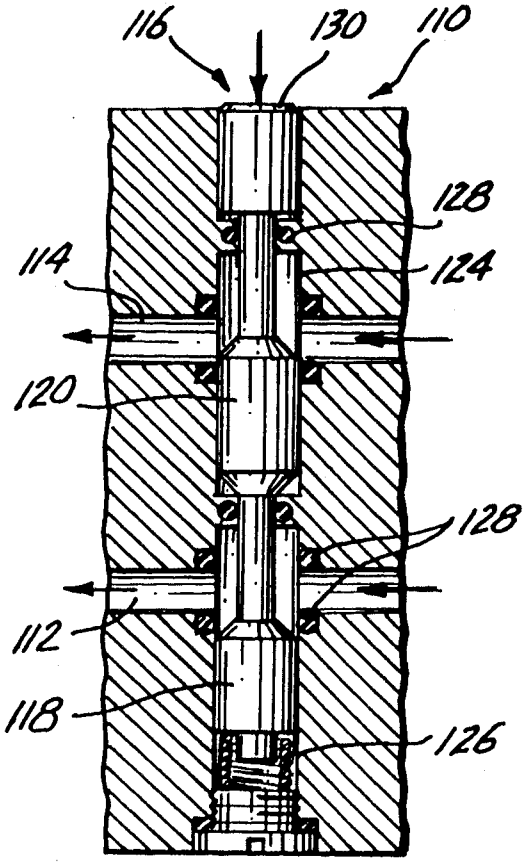
Figure 4A:
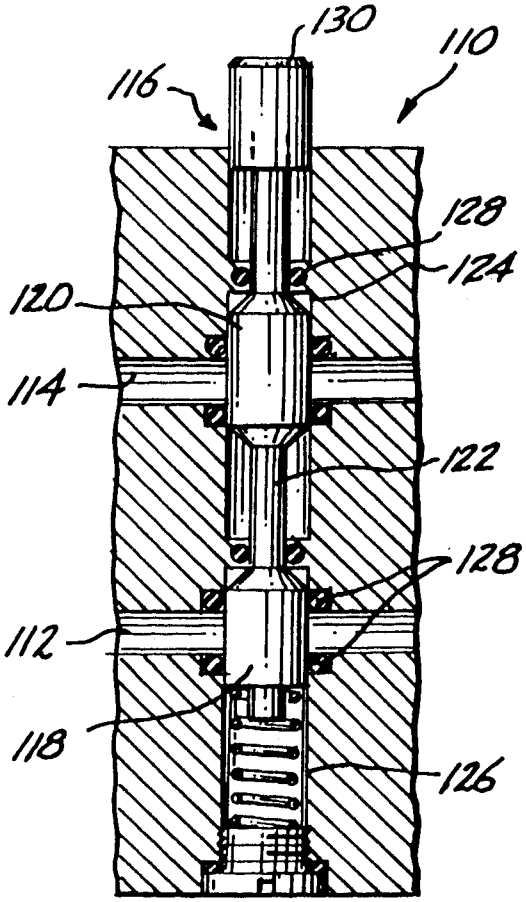

FIG. 4*a* illustrates a portion of an alternative dispensing head 110 from which drinks can be discharged from the beverage dispensing system 10 of this invention. For each concentrate the system 10 is capable of dispensing, dispensing head 110 includes a concentrate passageway 112, one shown, that extends from an inlet port to which a concentrate supply line 62 (FIG. 1) is connected to a discharge port (inlet and discharge ports not illustrated). Dispensing head 110 is also formed with fluid passageways 114, one shown, that function as conduits for fluid that flows through the fluid supply lines 64 (FIG. 1) paired with the concentrate supply lines 62.

Flow through each pair of concentrate and fluid passageways, 112 and 114 respectively, is controlled by a button actuated, normally closed valve 116. The valve 116 includes a pair of axially aligned spools, 118 and 120 respectively, that are attached to a longitudinally extending valve stem 122. The valve spools 118 and 120 and the valve stem 122 are located in a valve bore 124 that extends perpendicularly through paired concentrate and fluid passageways 112 and 114 respectively. Valve 116 is constructed so that when in the closed position, the upper portion of spool 118 is in concentrate passageway 112 and the lower portion of spool 120 is in fluid passageway 114 so as to block flow in the passageways. A spring 126 in the base of the valve bore 124 adjacent valve spool 118 biases the valve 116 so that it is normally closed. Seals 128 located around the passageway-valve bore interfaces and at the head of the valve bore 124 form barriers that block liquid flow into the bore. Valve 116 is further constructed so that valve spool 118 has an outside diameter marginally less than the inside diameter of the adjacent seals 128. A button 130 attached to the head of the valve stem 122 is used to selectively urge the spools 118 and 120 into the valve bore 124 below the passageways 112 and 114 respectively so as to allow unrestricted flow therethrough.

Beverages are dispensed from the system 10 with dispensing head 110 by depressing the valve button 130 associated with the desired beverage. While the valve spools 118 and 120 move in unison, the offset spacing of the spools relative to the passageways 112 and 114 causes the valve 116 to open and close the passageways consecutively rather than simultaneously. Initially, valve spool 118 moves out of concentrate passageway 112 so that it opens. A short time later, valve spool 120 moves out fluid passageway 120 so that it opens. The opening of the fluid passageway 120 and subsequent discharge of fluid therefrom actuates the associated pump 20. The pump 20, in turn, forces concentrate through the concentrate supply line 62 and concentrate passageway 112 where it is discharged. Upon discharge from the dispensing head 110, the concentrate and fluid mix so as to form the desired beverage. As shown in FIG. 4*b*, when the passageways 112 and 114 are open, valve spool 118 is located a distance below the concentrate passageway 112 while valve spool 120 is located immediately below fluid passageway 114.

Releasing the button 130 restores the valve spools 118 and 120 to their closed positions. Valve spool 120, which is located just below fluid passageway 114, nearly instantaneously returns to the passageway so as to block fluid flow therethrough, as depicted in FIG. 4*c*. Valve spool 118, which is located a distance below the concentrate passageway 112, returns to its normal flow-blocking position a short time later. In between the closing of the passageways 114 and 112 respectively, the closing of the fluid passageway 114 deactivates the pump 20. This causes the flow of concentrate through the concentrate passageway 112 to cease. Thus, when the valve spool 118 moves into position to close the concentrate passageway 112, the flow of concentrate therethrough has essentially already stopped.

The relatively small diameter of the valve spool 118, relative to the seals 128, allows concentrate to bleed through the concentrate passageway 112 when excessive pressure builds up in the concentrate supply piping upstream of the valve 116. This can happen if minor leaks in the fluid supply piping actuate the pump 20 so that concentrate is forced through the concentrate supply line 62. In a preferred embodiment of the invention, valve spool 118 is dimensioned to allow concentrate to bleed through the concentrate passageway 112 when its pressure exceeds approximately 40 psi.

Discharging beverage through head 110 eliminates the problems that can occur when the concentrate and fluid passageway are simultaneously closed. Concentrate flow can have a pressure of approximately 200 psi. Rapidly closing the concentrate passageway simultaneously with closing the fluid passageway can result in a rapid internal pressure build-up in the pump 20, the concentrate supply line, the concentrate passageway and around the associated points. Valve 116 initially stops flow in the fluid passageway 114 so that the pump 20 is deactivated. Deactivation of the pump 20 causes the concentrate flow to cease so that the pressure in concentrate supply line 62 and concentrate passageway 112 is allowed to dissipate before the concentrate passageway is closed. This minimizes the pressure and associated stress to which the pump 20, concentrate supply line 20, concentrate passageway 112 and valve 116 are exposed. This reduces the rate at which these components fatigue so as to maximize their useful lives.

The longevity and integrity of the beverage dispensing system 10 is further enhanced by the design of the valve 116 that allows concentrate to bleed around the valve spool 118. In the event a minor leak causes liquid flow through the fluid side of any pump 20, concentrate forced into the dispensing head 110 is bled around the valve spool 118 and discharged. This prevents the build-up of pressure in the concentrate supply line 62 and concentrate passageway 112 which, over time, can fatigue these components to the point where they rupture.

Moreover, the wholesomeness of the concentrate is not appreciably affected by the construction of valve spool 118 that allows concentrate to bleed around it. The surface tension of the concentrate at the head of the concentrate flow adjacent the valve spool 118 normally restricts unpressurized flow around the valve spool. Since the head of the concentrate flow is maintained close to the discharge port, the stored concentrate is not exposed to the atmosphere. Consequently the concentrate is not in an environment in which the growth of fungus and bacteria is fostered.

Figure 5:
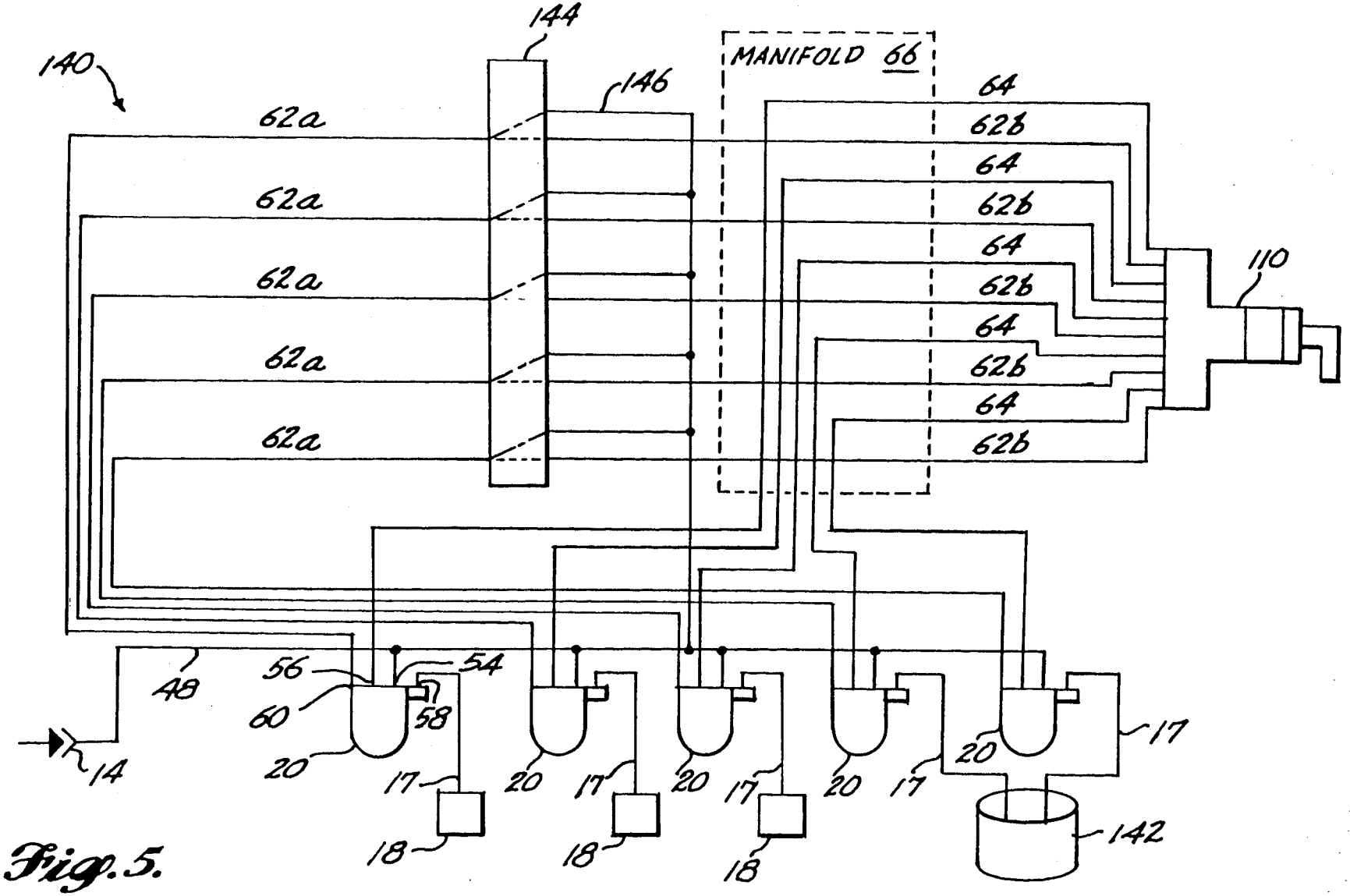
FIG. 5 is a functional block diagram of an alternative piping system for the beverage dispensing system of this invention.

Beverage dispensing system 10 may also be provided with an alternative piping system 140, depicted in the block diagram of FIG. 5, that facilitates the cleaning of the dispensing system. In this figure, cartons 18 containing beverage concentrate are shown as being connected to the first three pumps 20 such as when the system 10 is being operated in the normal, beverage dispensing, mode. A bucket 142 for holding either detergent or rinse water is shown connected to the last two pumps 20 as is the situation when the system 140 is being cleaned. In this embodiment of the invention, the concentrate supply lines from the individual pumps 20 are split into two sections, **62*a* and 62*b* respectively, and are connected to a common, manually actuated valve-manifold 144. The valve-manifold 144, like the other components of the system 10, is attached to an appropriate location on the frame 12 (FIG. 1). The valve-manifold 144 has two settings. In a first, or operational mode, setting the concentrate supply line sections 62*a* and 62*b* are connected together. In the second, or cleaning mode, setting the concentrate supply line sections 62*a* connected to the pumps 20 are connected to a common return line 146. The second end of the fluid line 146 is connected to the fluid line 48 that supplies fluid to the pump fluid inlet ports 54**.

In normal operation, valve-manifold 144 is in operational mode setting and the individual sections **62*a* and 62*b* of the concentrate supply line are in fluid communication. Concentrate flows from the containers 18 and pumps 20 through the concentrate supply line sections 62*a* and 62*b* for discharge from the dispensing head 110**.

The piping system 140 is cleaned by initially disconnecting all of the pump inlet lines 17 from the cartons 18. If the piping system 140 is not normally connected to a source of fresh water, it is now so connected. Residual concentrate is then flushed from the pump inlet lines 17, the pumps 20, the concentrate supply line sections **62*a* and 62*b* and the dispensing head concentrate passageways 112. This is accomplished by placing the pump inlet lines 17 in a bucket 142 containing warm water. The dispensing head valves 116 (FIG. 4) are selectively opened to activate the pumps 20 one at a time. When an individual pump 20 is activated, warm water is drawn through the pump inlet line 17, the pump 20, the concentrate supply line sections 62*a* and 62*b* and the concentrate passageway 112 so as to flush the concentrate from the piping system 140. This process is then repeated for each pump 20 and the associated piping used to supply concentrate. The next step in the cleaning process is to force detergent through the concentrate supply piping. This is accomplished by connecting a bucket 142 containing detergent to the pump inlet lines 17. The dispensing head valves 116 are again selectively opened so that detergent is forced through each pump 20** and the associated concentrate supply piping.

After detergent has been run through all of the concentrate supply piping, the fluid supply side of the piping system 140 is ready for cleaning. The valve-manifold 144 is set to the cleaning mode. The bucket 142 containing detergent remains connected to the pump inlet lines 17. Each dispensing head valve 116 is again selectively actuated. When each valve 116 is opened, the associated pump 20, as before, forces the detergent from the bucket 142 through the first concentrate supply line section **62*a*. The detergent is then directed by the valve manifold 144 through the return line 146 into the fluid inlet line 48. The detergent then flows through the fluid side of the pump 20, the fluid supply line 64 and the fluid passageway 114. By selectively opening each dispensing head valve 116, detergent is run through each pump 20 and the associated fluid supply piping. Residual detergent is then flushed from the fluid side of the system by connecting a bucket 142 of rinse water to the pump inlet lines 17. The rinse water is run through each pump 20 and the associated fluid supply piping in a manner identical to the process for supplying the detergent. After the rinse water is run through the fluid supply piping, the cleaning of the fluid supply side of the piping system 140** is complete.

After the fluid supply side of the system 140 has been cleaned, the valve-manifold 144 is reset to the operational mode. Residual detergent in the concentrate supply side of the system 140 is flushed by leaving the pump inlet lines connected to the bucket 142 of rinse water. Each dispensing head valve 116 is opened so that the rinse water is forced through each pump 20 and the associated concentrate supply piping so as to flush out any residual detergent. After the concentrate supply side piping has been flushed, the piping system 140 is completely clean. The pump inlet lines 17 are then reconnected to the cartons 18 so that the beverage dispensing system 10 can be returned to normal use.

Piping system 140 simplifies the cleaning of the beverage dispensing system 10. Detergent and rinse water are drawn through the fluid supply side of the piping system 140 by the pumps 20 that normally force concentrate through the system. This eliminates the need to provide an electrically driven pump 90 as is taught with respect to FIGS. 1 and 3 in order to supply the required detergent to the fluid supply side of the system 10. Since pump 90 is not required, the system 10 need not be connected to a source of electrical power. The system 10 is thus essentially self-contained save for requiring a fresh water source for cleaning and/or for when water is supplied as the concentrate-diluting fluid. The elimination of the pump 90 also eliminates the costs associated with providing and operating the pump.

The common valve-manifold 144 of the piping system 140 simplifies the cleaning of the beverage dispensing system 10. The valve-manifold 144 is only switched back and forth between the normal and cleaning mode settings once during the cleaning processes. This substantially reduces the possibility that sometime during the cleaning process the valve-manifold 144 will be inadvertently set so as to result in either the cleaning process being improperly performed or the concentrate being inadvertently routed through the fluid supply piping.

While a preferred embodiment of the invention has been illustrated and described, it is to be understood that various changes may be made therein without departing from the spirit and scope of the invention. For example, the moveable bar gun-type dispensing head may be replaced with a fixed fountain type dispensing head that is permanently attached to the top of the frame 12. Moreover, valve mechanisms other than those disclosed may be used to control the discharge of fluid and concentrate through the dispensing head. For example, it may be desirable in some embodiments of the invention to provide a dispensing head with valves that control flow only through the individual fluid passageways. Opening one of these valves would, in turn, actuate the associated pump so as to force the discharge of the associated concentrate. When the valve was closed the pump would be deactivated so as to stop the flow of concentrate. Surface tension of the concentrate in the concentrate passageway would then prevent the concentrate from leaking out of the dispensing head.

Moreover, pumps 20 do not all have to force the concentrate to the dispensing head at the same concentrate to diluting fluid ratio as has been described with respect to a preferred embodiment of the invention. The system 10 may be provided with pumps that force concentrate to the dispensing head in different proportions to the amount of discharged diluting fluid if that is what is required to produce acceptable beverages. Different concentrate to diluting fluid mixtures may be established by providing pumps that are set to discharge concentrate at different rates, or by providing pumps that allow the concentrate pumping rate to be adjusted.

It should also be understood that the disclosed use of water as the concentrate diluting fluid is similarly meant to be illustrative and not limiting. The beverage dispensing system 10 of this invention can quite clearly be used with other diluting fluids. For instance, it is apparent that the system 10 can be connected to a source of carbonated water and cartons containing syrup concentrate so that various soft drinks can be dispensed from the system. Furthermore, in some embodiments of the system 10 separate pumps 10 may be connected to separate sources of diluting fluid so that beverages that are formed out of different diluting fluids can be dispensed from the same system. For example, it would be possible to construct the system so that one or more pumps are connected to a source of plain water so that drinks such as juices could be dispensed and so that one or more pumps are connected to a source of carbonated water so that soft drinks could also be dispensed. Also, valve spool 118, which allows bleed through of the concentrate when the pressure in the concentrate supply line exceeds a given value, can be employed in other valves, such as the simultaneously acting valves 74 described with respect to FIG. 2.

Therefore, it is an object of the appended claims to cover all such modifications and variations as come within the true spirit and scope of the invention.

The embodiments of the invention in which an exclusive property or privilege is claimed are defined as follows:

1. A beverage dispensing system comprising:

a plurality of containers for storing beverage concentrate;

a plurality of proportion pumps, each said proportion pump having a fluid drive side and a fluid pumping side, said fluid drive side having a fluid inlet and a fluid outlet, and said pumping side having a concentrate inlet and a concentrate outlet;

means for coupling said fluid inlet of each of said pumps to a source of pressurized fluid;

means for coupling each said pump concentrate inlet to a separate one of said concentrate containers;

a plurality of pairs of fluid supply and concentrate supply lines, said fluid supply line and said concentrate supply line of each said pair of supply lines respectively coupled to a fluid outlet and a concentrate outlet of one of said proportion pumps, each said pair of supply lines coupled to a separate one of said proportion pumps;

a dispensing head to which said pairs of fluid and concentrate supply lines are attached, said dispensing head having an outlet through which fluid and beverage concentrate from said supply lines is discharged, said dispensing head including a plurality of valve means, each said valve means associated with a separate pair of said fluid and concentrate supply lines for selectively controlling the discharge of fluid from said associated fluid supply line so that when a selected valve means is opened, fluid flows from said associated fluid supply line, allowing fluid to flow through said respective proportion pump and causing concentrate to flow from said concentrate supply line and be discharged concurrently with fluid from said dispensing head outlet.

2. The beverage dispensing system of claim 1 wherein said dispensing head is adapted so that at least two said valve means can be selectively opened simultaneously so that fluid will be charged from said fluid supply lines associated with said open valves and concentrate will be discharged from said concentrate supply lines associated therewith.

3. The beverage dispensing system of claim 1 wherein said means for coupling said pump fluid inlets is connected to a common source of pressurized fluid.

4. The beverage dispensing system of claim 1 further including a plurality of vacuum-actuated valves, wherein each said vacuum-actuated valve is connected to a separate one of said concentrate containers and a plurality of concentrate inlet lines, wherein each said inlet line extends between a separate one of said vacuum-actuated valves and said concentrate inlet of said proportion pump associated with said concentrate container to which said vacuum-actuated valve is connected.

5. The beverage dispensing system of claim 4 wherein said concentrate containers are removably mounted to a frame.

6. The beverage dispensing system of claim 1 further including: a return line connected to said pump fluid inlets; and a valve-manifold to which said concentrate supply lines and said return fluid line are connected, said valve-manifold having a first setting whereby said concentrate supply lines are in fluid communication with said dispensing head and a second setting whereby said concentrate supply lines are in fluid communication with said return fluid line.

7. The beverage dispensing system of claim 6 wherein said valve means allows concentrate bleed through in said concentrate supply line when pressure therein exceeds a selected value.

8. The beverage dispensing system of claim 6 wherein each said valve means stops fluid flow by initially stopping fluid flow in said fluid supply line associated therewith and then stops fluid flow in said concentrate supply line associated therewith.

9. The beverage dispensing system of claim 8 wherein each said valve means upon opening, initially opens said concentrate supply line and then opens said fluid supply line.

10. The beverage dispensing system of claim 1 wherein each said valve means comprises a dispensing valve for simultaneously regulating flow through a specific concentrate supply line and said fluid supply line paired therewith.

11. The beverage dispensing apparatus of claim 10 wherein said dispensing head is formed with a plurality of paired concentrate passageways and fluid passageways such that each concentrate supply line is connected to a separate said concentrate passageway and each said fluid supply line paired therewith is connected to said fluid passageway paired with the aforesaid concentrate passageway, and each said dispensing valve is arranged to selectively control the flow through a specific concentrate passageway and said paired fluid passageway.

12. The beverage dispensing system of claim 10 wherein said concentrate containers are removably mounted to a frame.

13. The beverage dispensing system of claim 10 wherein said dispensing valve allows concentrate bleed through in said concentrate supply line when pressure therein exceeds a selected value.

14. The beverage dispensing system of claim 10 further including a plurality of vacuum-actuated valves, wherein each said vacuum-actuated valve is connected to a separate one of said concentrate containers and a plurality of concentrate inlet lines, wherein each said inlet line extends between a separate one of said vacuum-actuated valves and said concentrate inlet of said proportion pump associated with said concentrate container to which said vacuum-actuated valve is connected.

15. The beverage dispensing system of claim 14 wherein said concentrate containers are removably mounted to a frame.

16. The beverage dispensing system of claim 1 wherein each said valve means stops fluid flow by initially stopping fluid flow through said fluid supply line associated therewith and then stops fluid flow through said concentrate supply line associated therewith.

17. The beverage dispensing system of claim 16 wherein said concentrate containers are removably mounted to a frame.

18. The beverage dispensing system of claim 16 wherein said valve means allows concentrate bleed through in said concentrate supply line when pressure therein exceeds a selected value.

19. The beverage dispensing system of claim 16 further including a plurality of vacuum-actuated valves, wherein each said vacuum-actuated valve is connected to a separate one of said concentrate containers and a plurality of concentrate inlet lines, wherein each said inlet line extends between a separate one of said vacuum-actuated valves and said concentrate inlet of said proportion pump associated with said concentrate container to which said vacuum-actuated valve is connected.

20. The beverage dispensing system of claim 19 wherein said concentrate containers are removably mounted to a frame.

21. The beverage dispensing system of claim 16 wherein each said valve means upon opening, initially opens said concentrate supply line for fluid flow and then opens said fluid supply line for fluid flow.

22. The beverage dispensing apparatus of claim 21 wherein:

said dispensing head is formed with a plurality of concentrate passageways and a plurality of fluid passageways such that each concentrate supply line is connected to a separate said concentrate passageway and each said fluid supply line paired therewith is connected a specific paired fluid passageway and said dispensing head is further formed with a plurality of valve bores, each said valve bore extending through a separate said concentrate passageway and said fluid passageway paired therewith; and each said valve means is located in a separate said valve bore and includes a valve spindle, a first valve spool attached to said valve spindle for selectively controlling the flow through said concentrate passageway and a second valve spool attached to said valve spindle for selectively controlling the flow through said fluid passageway, said valve spools being selectively located relative to said passageways so that when said valve means is opened, said first spool initially opens said concentrate passageway and then said second spool opens said fluid passageway and when said valve means is closed, said second spool initially closes said fluid passageway and then said first spool closes said concentrate passageway.

23. The beverage dispensing system of claim 22 wherein said first valve spool allows concentrate bleed through in said concentrate passageway when pressure therein exceeds a selected value.

* * * * *

US005056686A

REEXAMINATION CERTIFICATE (1922nd)

United States Patent [19]

Jarrett

[11] B1 5,056,686

[45] Certificate Issued Feb. 2, 1993

[54] BEVERAGE DISPENSING SYSTEM

[75] Inventor: Charles C. Jarrett, Bellevue, Wash.

[73] Assignee: Nutri-Fruit, Inc., Bellevue, Wash.

Reexamination Request:
No. 90/002,694, Apr. 3, 1992

Reexamination Certificate for:

| | |
|---|---|
| Patent No.: | **5,056,686** |
| Issued: | **Oct. 15, 1991** |
| Appl. No.: | **530,116** |
| Filed: | **May 29, 1990** |

Related U.S. Application Data

[63] Continuation-in-part of Ser. No. 372,837, Jun. 27, 1989, abandoned.

[51] Int. Cl.[5] ..... B67D 5/56

[52] U.S. Cl. ..... 222/129.2; 222/325; 222/144.5

[58] Field of Search ..... 222/129.1-129.4, 222/132, 135, 144.5, 148, 189, 249, 255, 325, 608, 626

[56] References Cited

U.S. PATENT DOCUMENTS

| | | | |
|---|---|---|---|
| 3,735,898 | 5/1973 | Smith | 222/129.4 |
| 4,181,242 | 1/1980 | Zygiel et al. | 222/1 |
| 4,282,987 | 8/1981 | Thomas et al. | 222/70 |
| 4,323,004 | 4/1982 | Sereda et al. | 99/275 |
| 4,333,587 | 6/1982 | Fessler et al. | 222/129.1 |
| 4,708,266 | 11/1987 | Rudick | 222/105 |
| 5,000,352 | 3/1991 | Cleland | 222/129.2 |

OTHER PUBLICATIONS

SHURflo, "*Brix Proportion Pump Phase II Installation,*" *revision B, Aug., 1987, p. 6.*

SHURflo, product brochure "*Brix Pump,*" 1986 or 1987, p. 2.

SHURflo, product brochure, "*There's more than one way . . .* ", 1986? or 1987?, p. 1.

SHURflo, "*Brix Proportioning Pump General Application Guidelines,*" 1986? or 1987?, p. 5.

Multiplex, "*Multiplex Beverage Equipment Installation Instructions,*" Aug., 1988, p. 6.

Automatic Bar Controls brochure, "*Liquor Control Systems of Tomorrow Will Provide For . . .* ", 1980?, p. 1.

Electronic Dispensers International brochure and distributor price schedule, "*Electron-O-Mix/Mix-E-Lector,*" Apr., 1967, p. 1.

Electronic Dispensers International product brochure, "*Redi-Bar,*" pre-1980, p. 4.

Automatic Bar Control brochure, "*Portable Bar System,*" date unknown, p. 2.

*Primary Examiner*—Gregory L. Huson

[57] ABSTRACT

A beverage dispensing system for providing a number of different flavored drinks mixed from concentrate and fluid. The system has a number of containers for storing different flavors of concentrate and a piping system including a coupling adapted to receive pressurized fluid, such as water, from an external source. Each container is in fluid communication with a specific fluid-driven proportion pump that is also in fluid communication with the piping system. Separate concentrate and fluid supply lines extend from each pump to a dispensing head. Valves in the dispensing head control the discharge of fluid therefrom so that when a selected beverage is desired, the appropriate concentrate and fluid from the associated fluid supply line are discharged simultaneously to ensure that the end beverage contains the appropriate mixture of concentrate and fluid so as to be of acceptable quality.

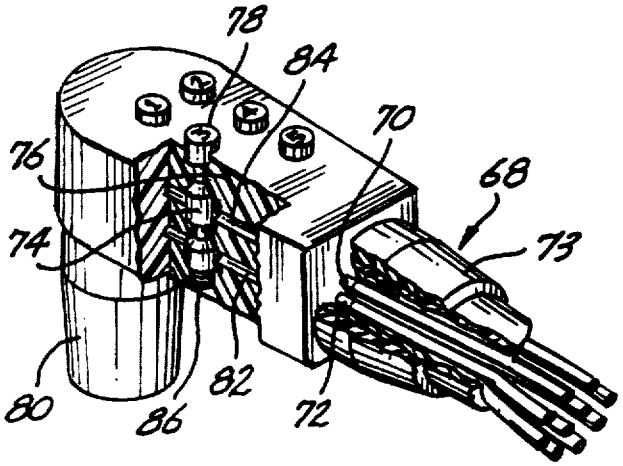

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 7, 13, 18 and 23 are determined to be patentable as amended.

Claims 3, 4 to 6, 8 to 12, 14 to 17, and 19 to 22, dependent on an amended claim, are determined to be patentable.

1. A beverage dispensing system comprising:

a plurality of containers for storing beverage concentrate;

a plurality of proportion pumps, each said proportion pump having a fluid drive side and a fluid pumping side, said fluid drive side having a fluid inlet and a fluid outlet, and said pumping side having a concentrate inlet and a concentrate outlet;

means for coupling said fluid inlet of each of said pumps to a source of pressurized fluid;

means for coupling each said pump concentrate inlet to a separate one of said concentrate containers;

a plurality of pairs of *flexible* fluid supply and *flexible* concentrate supply lines, said fluid supply line and said concentrate supply line of each said pair of supply lines respectively coupled to a fluid outlet and a concentrate outlet of one of said proportion pumps, each said pair of supply lines coupled to a separate one of said proportion pumps;

a dispensing head to which said pairs of fluid and concentrate supply lines are attached, said dispensing head having an outlet through which fluid and beverage concentrate from said supply lines [is] *are* discharged, said dispensing head including a plurality of valve means, each said valve means associated with a separate pair of said fluid and concentrate supply lines for selectively controlling the discharge of fluid from said associated fluid supply line so that, when a selected valve means is opened, fluid flows from said associated fluid supply line, allowing fluid to flow through said respective proportion pump and causing concentrate to flow from said concentrate supply line and be discharged concurrently with fluid from said dispensing head outlet.

2. The beverage dispensing system of claim 1 wherein said dispensing head is adapted so that at least two said valve means can be selectively opened simultaneously so that fluid will be [charged] *discharged* from said fluid supply lines associated with said open valves and concentrate will be discharged from said concentrate supply lines associated therewith.

7. The beverage dispensing system of claim 6 wherein said valve means allows concentrate [bleed through] *bleedthrough* in said concentrate supply line when pressure therein exceeds a selected value.

13. The beverage dispensing system of claim 10 wherein said dispensing valve allows concentrate [bleed through] *bleedthrough* in said concentrate supply line when pressure therein exceeds a selected value.

18. The beverage dispensing system of claim 16 wherein said valve means allows concentrate [bleed through] *bleedthrough* in said concentrate supply line when pressure therein exceeds a selected value.

23. The beverage dispensing system of claim 22 wherein said first valve spool allows concentrate [bleed through] *bleedthrough* in said concentrate passageway when pressure therein exceeds a selected value.

* * * * *